US011841179B2

(12) United States Patent
Taras

(10) Patent No.: US 11,841,179 B2
(45) Date of Patent: Dec. 12, 2023

(54) HEATING, VENTILATION, AND AIR-CONDITIONING SYSTEMS AND METHODS

(71) Applicant: Goodman Global Group, Inc., Waller, TX (US)

(72) Inventor: Michael F Taras, The Woodlands, TX (US)

(73) Assignee: Goodman Global Group, Inc., Waller, TX (US)

( * ) Notice: Subject to any disclaimer, the term of this patent is extended or adjusted under 35 U.S.C. 154(b) by 290 days.

(21) Appl. No.: 16/742,351

(22) Filed: Jan. 14, 2020

(65) Prior Publication Data

US 2021/0215400 A1 Jul. 15, 2021

(51) Int. Cl.
*F25B 9/02* (2006.01)
*F24F 5/00* (2006.01)
(Continued)

(52) U.S. Cl.
CPC ..... *F25B 9/04* (2013.01); *F24F 5/0096* (2013.01); *F25B 9/06* (2013.01); *F25B 30/02* (2013.01); *F25B 49/02* (2013.01)

(58) Field of Classification Search
CPC .... F25B 9/04; F25B 9/06; F25B 30/02; F25B 49/02; F25B 2400/23; F25B 2400/0409; F24F 5/0096; F24F 3/001; F24F 2221/18
See application file for complete search history.

(56) References Cited

U.S. PATENT DOCUMENTS 3,600,904 A * 8/1971 Tilney ..... F25B 41/315 62/503
4,326,868 A * 4/1982 Ozu ..... F04C 29/042 417/284

(Continued)

FOREIGN PATENT DOCUMENTS

CN 110345584 A * 10/2016
EP 2873934 A1 5/2015

(Continued)

OTHER PUBLICATIONS

Nakada et al., Deep Freezer, Jan. 10, 1997, JPH094932A, Whole Document (Year: 1997).*

(Continued)

*Primary Examiner* — Larry L Furdge
(74) *Attorney, Agent, or Firm* — K&L Gates LLP

(57) ABSTRACT

A heating, ventilation, and air-conditioning ("HVAC") system for use with a refrigerant. The HVAC system includes a compressor, a condenser, an expansion device, an evaporator, and a separator. The compressor is operable to compress the refrigerant. The condenser is positioned downstream of the compressor and operable to condense the refrigerant. The expansion device is positioned downstream of the condenser and operable to reduce a pressure of the refrigerant flowing therethrough. The evaporator is positioned downstream of the expansion device and operable to vaporize the refrigerant from the expansion device. The separator is positioned downstream of the expansion device and operable to separate the refrigerant into liquid refrigerant and gaseous refrigerant. The gaseous refrigerant from the separator and the liquid refrigerant from the separator are combined prior to being compressed by the compressor.

14 Claims, 2 Drawing Sheets

(51) Int. Cl.

| | |
|---|---|
| ***F25B 9/04*** | (2006.01) |
| ***F25B 49/02*** | (2006.01) |
| ***F25B 30/02*** | (2006.01) |
| ***F25B 9/06*** | (2006.01) |

(56) References Cited

U.S. PATENT DOCUMENTS

| | | | | |
|---|---|---|---|---|
| 4,341,086 | A * | 7/1982 | Ishii | F25B 41/335 55/319 |
| 2009/0223232 | A1 | 9/2009 | Rolfsman et al. | |

FOREIGN PATENT DOCUMENTS

| | | | |
|---|---|---|---|
| JP | H094932 | A * | 1/1997 |
| JP | 4250320 | B2 | 4/2009 |
| JP | 2014066427 | A * | 4/2014 |
| JP | 2014181869 | A * | 9/2014 |
| JP | 2015218939 | A | 12/2015 |
| KR | 101824999 | B1 | 2/2018 |

OTHER PUBLICATIONS

Taki, Air Conditioner, Sep. 29, 2014, JP2014181869A, Whole Document (Year: 2014).*

Nishimura et al., Refrigerator, Apr. 17, 2014, JP2014066427A, Whole Document (Year: 2014).*

Dehua et al., Jet Throttling Independent Temperature and Humidity Control Air Conditioning System, Oct. 18, 2019, CN110345584A, Whole Document (Year: 2019).*

International Search Report and Written Opinion dated May 21, 2021 for corresponding PCT Application No. PCT/US2021/013346 filed Jan. 14, 2021, 10 pages.

* cited by examiner

HEATING, VENTILATION, AND AIR-CONDITIONING SYSTEMS AND METHODS

BACKGROUND

This section is intended to provide relevant background information to facilitate a better understanding of the various aspects of the described embodiments. Accordingly, these statements are to be read in this light and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature and humidity. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses compressors and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air or another secondary fluid. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers, transitioning between phases along the way, absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

For both heating and cooling of indoor spaces, the performance of a typical HVAC system is affected by the temperature of the refrigerant discharged from the compressor, where a lower discharge temperature increases system efficiency. Additionally, high refrigerant discharge temperatures can increase wear on the compressor. Therefore, an increase in both system performance and compressor reliability can be achieved by reducing the temperature of the refrigerant discharged from the compressor.

BRIEF DESCRIPTION OF THE DRAWINGS

Embodiments of the HVAC system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes heating, ventilation, and air-conditioning ("HVAC") systems having a refrigerant bypass. The refrigerant bypass lowers the temperature of the refrigerant entering the compressor and, in turn, the temperature of the refrigerant discharged from the compressor, increasing compressor reliability and HVAC system performance. The HVAC system also includes a refrigerant phase separator and suction accumulator that allows for further control over the compressor discharge temperature and enhanced performance of the HVAC system.

Figure 1:
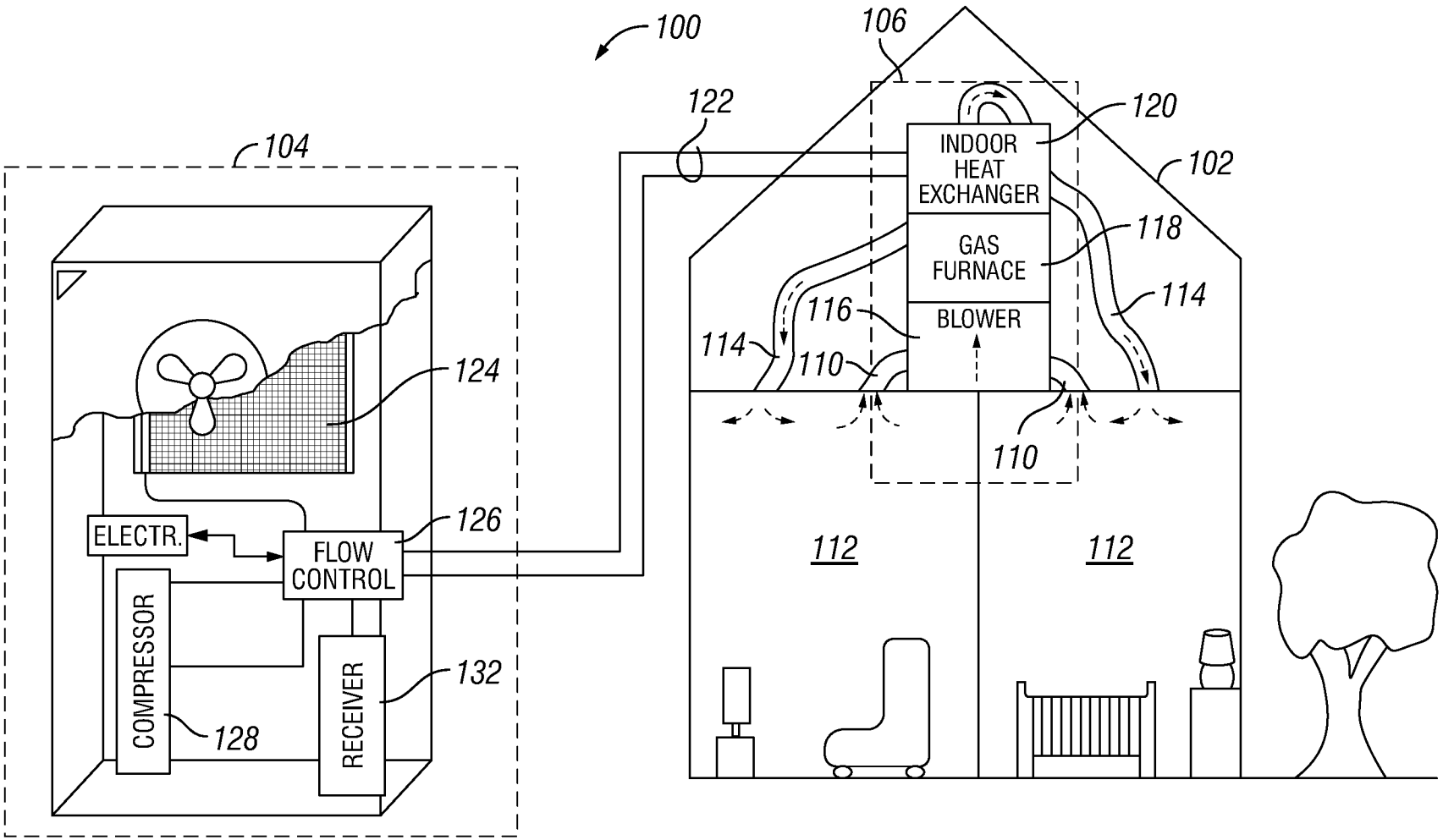
FIG. 1 is a block diagram of an HVAC system, according to one or more embodiments.

Turning now to the figures, FIG. 1 is an HVAC system 100 in accordance with one embodiment. As depicted, the system 100 provides heating and cooling for a residential structure 102. However, the concepts disclosed herein are applicable to numerous of heating and cooling situations, which include industrial and commercial settings.

The described HVAC system 100 divides into two primary portions: The outdoor unit 104, which mainly comprises components for transferring heat with the environment outside the structure 102; and the indoor unit 106, which mainly comprises components for transferring heat with the air inside the structure 102. To heat or cool the illustrated structure 102, the indoor unit 106 draws indoor air via returns 110, passes that air over one or more heating/cooling elements (i.e., sources of heating or cooling), and then routes that conditioned air, whether heated or cooled, back to the various climate-controlled spaces 112 through ducts or ductworks 114, which are relatively large air conduits that may be rigid or flexible. A blower 116 provides the motivational force to circulate the ambient air through the returns 110 and the ducts 114.

As shown, the HVAC system 100 is a "dual-fuel" system that has multiple heating elements. A gas furnace 118 located downstream (in relation to the airflow) of the blower 32 combusts natural gas to produce heat in furnace tubes (not shown) that coil through the gas furnace 118. These furnace tubes act as a heating element for the indoor air being pushed out of the blower 116, over the furnace tubes, and into the ducts 114. However, the gas furnace 118 is generally operated when robust heating is desired. In other embodiments, an electric heater elements may be used in place of or in combination with the gas furnace 118. During conventional heating and cooling operations, air from the blower 116 is routed over an indoor heat exchanger 120 and into the ductwork 114. The blower 116, the gas furnace 118, and the indoor heat exchanger 120 may be packaged as an integrated air handler unit, or those components may be modular. In other embodiments, the positions of the gas furnace 118, the indoor heat exchanger 120, and the blower 116 can be reversed or rearranged.

In at least one embodiment, the indoor heat exchanger 120 acts as a heating or cooling element that add or removes heat from the structure, respectively, by manipulating the pressure and flow of refrigerant circulating within and between the indoor and outdoor units via refrigerant lines 122. In another embodiment, the refrigerant could be circulated to only cool (i.e., extract heat from) the structure, with heating provided independently by another source, such as, but not limited to, the gas furnace 118. In other embodiments, there may be no heating of any kind. HVAC systems 100 that use refrigerant to both heat and cool the structure 102 are often described as heat pumps, while systems 100 that use refrigerant only for cooling are commonly described as air conditioners.

Whatever the state of the indoor heat exchanger 120 (i.e., absorbing or releasing heat), the outdoor heat exchanger 124 is in the opposite state. More specifically, if heating is desired, the illustrated indoor heat exchanger 120 acts as a condenser, aiding transition of the refrigerant from a high-pressure gas to a high-pressure liquid and releasing heat in the process. The outdoor heat exchanger 124 acts as an evaporator, aiding transition of the refrigerant from a low-pressure liquid to a low-pressure gas, thereby absorbing heat from the outdoor environment. If cooling is desired, the outdoor heat exchanger 124 acts as a condenser, aiding transition of the refrigerant from a high-pressure gas to a high-pressure liquid and releasing heat in the process, and the indoor heat exchanger 120 acts as an evaporator, aiding transition of the refrigerant from a low-pressure liquid to a low-pressure gas. A flow control device 126, e.g., a reversing, or four-way, valve, within either the outdoor unit 104, as shown in FIG. 1, or within the indoor unit 106 controls the flow of refrigerant within the system, allowing the system to both heat and cool the structure 102.

In the illustrated embodiment, the flow control device also acts as an expansion device, i.e. an expansion valve, reducing the pressure of the refrigerant prior to the refrigerant entering the heat exchanger 120, 124 that is currently operating as the evaporator, and a separator, separating the low-pressure refrigerant into gaseous refrigerant and liquid refrigerant. The liquid refrigerant is then flowed from the flow control device 126 to the heat exchanger 120, 124 currently operating as the evaporator. The gaseous refrigerant bypasses the heat exchanger 120, 124 currently operating as the evaporator and is combined with the refrigerant exiting the heat exchanger 120, 124 currently operating as the evaporator prior to the refrigerant entering a compressor 128. As the refrigerant exiting the heat exchanger 120, 124 currently operating as the evaporator may be a superheated vapor, combining the separated gaseous refrigerant in the saturated vapor state with the superheated vapor refrigerant will lower the temperature of the refrigerant entering the compressor 128 and, in turn, the temperature of the refrigerant exiting the compressor 128.

Figure 3:
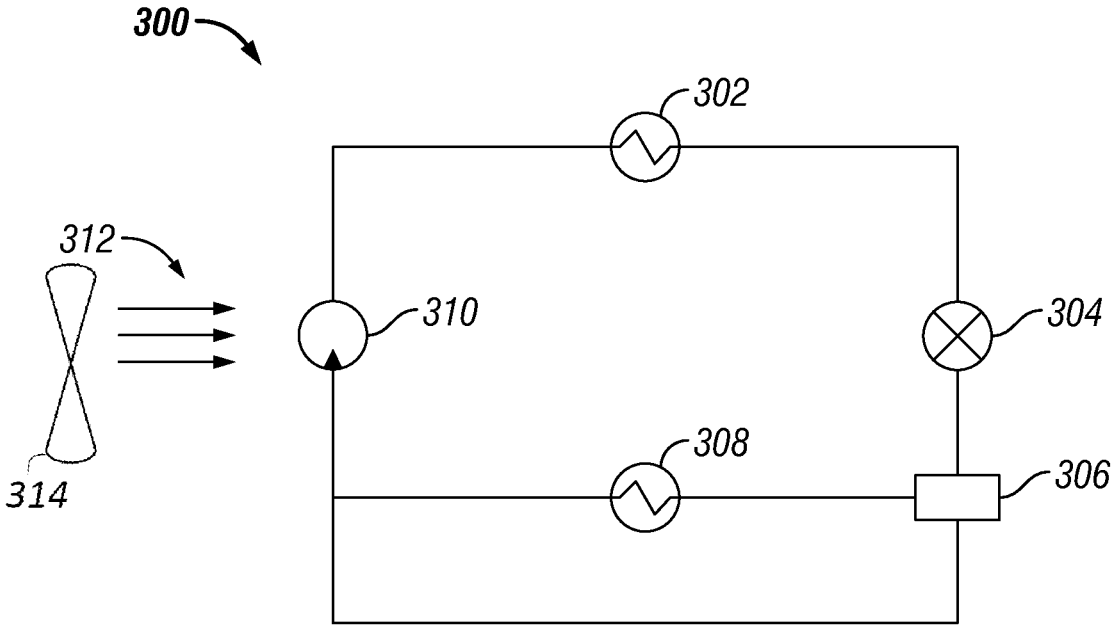
FIG. 3 is a simplified block diagram of an HVAC system, according to one or more embodiments.

In other embodiments, the system 100 may function similarly; however, at least one of the separator and the expansion device may be separated from the flow control device 126. In other embodiments, the separator and the expansion device may be combined into a single device separate from the flow control device 126 or separated into two distinct devices that are distinct from the flow control device 126, as shown in FIG. 3.

The illustrated outdoor unit 104 also includes a receiver 132 that helps maintain a sufficient amount of refrigerant charge in the system 100. The size of these components is often defined by the amount of refrigerant employed by the system 100. For example, the receiver 130 may be sized such that it is fifteen percent (15%) larger than the total amount of refrigerant present in the system 100. In another embodiment, the system 100 may be designed without a receiver 132.

Figure 2:
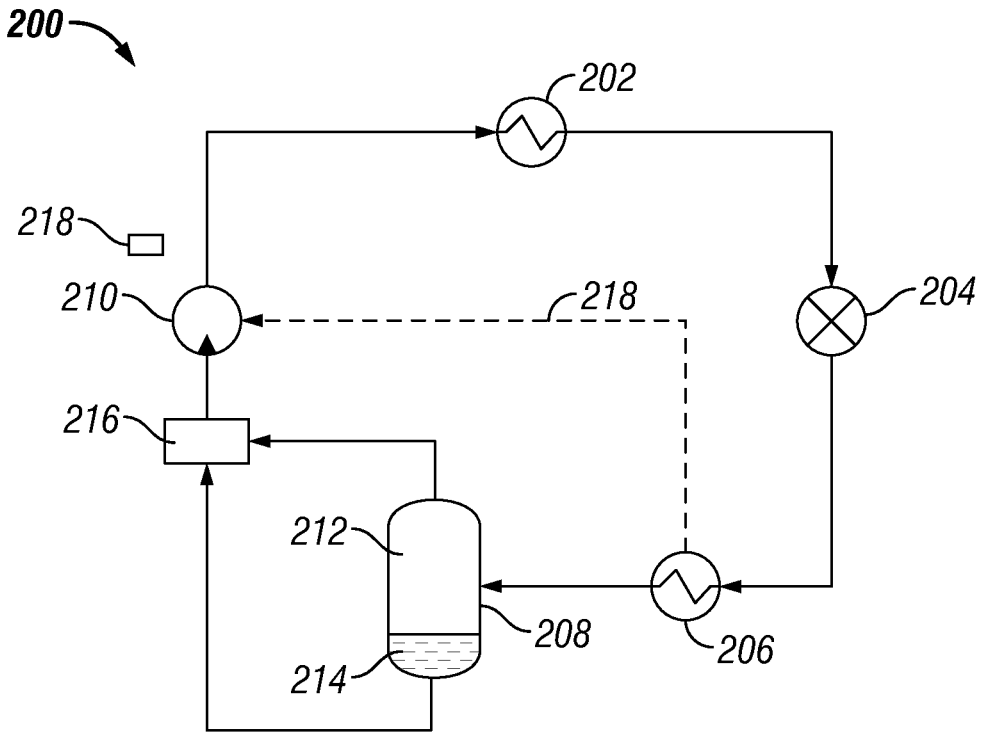
FIG. 2 is a simplified block diagram of an HVAC system, according to one or more embodiments.

Referring now to FIG. 2, FIG. 2 is a simplified block diagram of an HVAC system 200. The HVAC system 200 includes a first heat exchanger 202, an expansion device 204 (i.e., an expansion valve), a second heat exchanger 206, a suction accumulator and refrigerant separator 208, and a compressor 210. The HVAC system 200 may also include the equipment shown in FIG. 1 and function as discussed above with reference to FIG. 1. Additionally, the first heat exchanger 202 may be either an indoor heat exchanger or an outdoor heat exchanger and the second heat exchanger 206 may be either an indoor heat exchanger or an outdoor heat exchanger, depending on the configuration of the HVAC system 200. Accordingly, the function of first heat exchanger 202, the expansion device 204, the second heat exchanger 206, and the compressor 210 will not be discussed in detail except as necessary for the understanding of the HVAC system 200 shown in FIG. 2.

As shown in FIG. 2, refrigerant flows from the compressor 210 to the first heat exchanger 202, where it is condensed, and then to the expansion device 204, i.e., expansion valve, where it is expanded from high-pressure refrigerant to low-pressure refrigerant. The low-pressure refrigerant is then evaporated in the second heat exchanger 206. Once the refrigerant exits the second heat exchanger 206, it flows into the suction accumulator and refrigerant separator 208, where it is separated into gaseous refrigerant 212 and liquid refrigerant 214 via a vortex separator, coalescing separator, gravity separator, or other similar means.

After the refrigerant is separated, a three-way valve 216 or similar flow control device is operated to combine the gaseous refrigerant 212 and the liquid refrigerant 214 from the suction accumulator and refrigerant separator 208 into a mixture having a specified quality. In at least one embodiment, this is done automatically via computer control. In another embodiment, the valve is opened operated manually to select a specified mixture quality. Combining the gaseous refrigerant 212 and the liquid refrigerant 214 lowers the temperature of the low-pressure refrigerant entering the compressor 210 and, in turn, the temperature of the high-pressure refrigerant exiting the compressor 210, improving system performance and extending the life of the compressor. In other embodiments, a pair of conventional valves may be used in place of the three-way valve 216.

The flow control device 216 controls the vapor quality of the refrigerant mixture entering the compressor 210. In one scenario, the refrigerant mixture entering the compressor 210 does not contain any liquid refrigerant; however, the vapor refrigerant exiting the suction accumulator and refrigerant separator 208 is in the saturated vapor state with no superheat. Therefore, the compressor discharge temperature will be reduced in a similar manner, although to a lesser amount in comparison to the condition when a vapor-liquid refrigerant mixture enters the compressor 210.

In at least one embodiment, the flow control device 216 controls the amount of liquid refrigerant entering the compressor 210, typically by the feedback loop from a compressor discharge temperature sensor 218 to assure stable, reliable and safe operation of the compressor 210. Furthermore, the suction accumulator and refrigerant separator 208 may have an additional function of controlling the refrigerant charge distribution throughout the HVAC system 200 acting as a refrigerant charge compensator, while the HVAC system 200 switches between a cooling and heating modes or operates at various environmental conditions.

Additionally, condensed water vapor, also known as condensate, forms on the external surfaces of the evaporator 206 as heat is absorbed to convert at least a portion of the liquid refrigerant exiting the expansion device 204 into gaseous refrigerant 212. As shown in FIG. 2, the condensate from the evaporator 206 can be flowed via tubing 218 into or over the outer shell of the compressor 210, reducing the temperature of the compressor 210 as it is compressing the refrigerant. Similar to lowering the temperature of the refrigerant exiting the compressor 210, lowering the temperature of the compressor itself extends the life of the compressor. The condensate may be delivered to the compressor 210 by gravity, condensate pump or other similar means.

Referring now to FIG. 3, FIG. 3 is a simplified block diagram of an HVAC system 300. The HVAC system 300 includes a first heat exchanger 302, an expansion device 304 (i.e., expansion valve), a separator 306, a second heat exchanger 308, and a compressor 310. Additionally, the first heat exchanger 302 may be either an indoor heat exchanger or an outdoor heat exchanger and the second heat exchanger 308 may be either an indoor heat exchanger or an outdoor heat exchanger, depending on the configuration of the HVAC system 300. The HVAC system 300 may also include the equipment shown in FIG. 1 and function as discussed above with reference to FIG. 1. Accordingly, the function of first heat exchanger 302, the expansion device 304, the separator 306, the second heat exchanger 308, and the compressor 310 will not be discussed in detail except as necessary for the understanding of the HVAC system 300 shown in FIG. 3.

Similar to FIG. 1, the refrigerant exiting the expansion device 304, i.e., expansion valve, is separated via the separator 306 into gaseous refrigerant and liquid refrigerant. The separator 306 may be a separator valve, a vortex separator, a coalescing separator, a gravity separator, or other type of separator known to those skilled in the art. The liquid refrigerant is then vaporized in the second heat exchanger 308 and then combined with the gaseous refrigerant exiting the separator 306 to lower the temperature of the high-pressure, high temperature refrigerant exiting the compressor 310. In addition to lowering the temperature of the discharged refrigerant, air 312 can be blown over the compressor by operating a fan 314, as shown in FIG. 3, further reducing the temperature of the compressor, improving system performance and extending the life of the compressor.

The vapor refrigerant exiting the expansion device 304 does not participate in the heat absorption and evaporation process that occurs in the second heat exchanger 308. However, this refrigerant vapor causes additional pressure drop in the evaporator that often leads to an increased number of evaporator circuits associated with the increased costs, higher degree of complexity and available space limitations. Therefore, it is desirable to bypass the vapor refrigerant around the second heat exchanger 308. Several intermediate bypass points within the second heat exchanger 308 can be added to the second heat exchanger 308 design configuration, combining the evaporated refrigerant flows and rerouting those combined refrigerant flows around the second heat exchanger 308. The bypassed refrigerant will have no superheat and will, in turn, reduce suction and discharge temperatures of the refrigerant respectively entering and leaving compressor 310.

Although the use of condensate to cool the compressor is only shown with the HVAC system 200 including a suction accumulator and refrigerant separator 208 and the use of air 312 to cool the compressor is only shown with the HVAC system 300 including a separator 306, the invention is not thereby limited. The use of condensate or air to cool a compressor may be utilized with any of the HVAC system discussed herein. Further, some HVAC systems may use both air and condensate to cool the compressor. Similarly, some HVAC systems may utilize both a suction accumulator and refrigerant separator 208 and a separator 306. In such embodiments, the flow control device 126 upstream of the compressor may combine the gaseous refrigerant exiting the separator 306 with the gaseous refrigerant 212 and the liquid refrigerant 214 contained within the accumulator 208 into a mixture having a specified quality.

Further examples include:

Example 1 is a HVAC system for use with a refrigerant. The HVAC system includes a compressor, a condenser, an expansion device, an evaporator, and a separator. The compressor is operable to compress the refrigerant. The condenser is positioned downstream of the compressor and operable to condense the refrigerant. The expansion device is positioned downstream of the condenser and operable to reduce a pressure of the refrigerant flowing therethrough. The evaporator is positioned downstream of the expansion device and operable to vaporize the refrigerant from the expansion device. The separator is positioned downstream of the expansion device and operable to separate the refrigerant into liquid refrigerant and gaseous refrigerant. The gaseous refrigerant from the separator and the liquid refrigerant from the separator are combined prior to being compressed by the compressor.

In Example 2, the embodiments of any preceding paragraph or combination thereof further include tubing configured to flow condensate from the evaporator through or over a shell of the compressor.

In Example 3, the embodiments of any preceding paragraph or combination thereof further include a fan operable to blow air over the compressor.

In Example 4, the embodiments of any preceding paragraph or combination thereof further include a receiver.

In Example 5, the embodiments of any preceding paragraph or combination thereof further include a flow control device operable to allow the HVAC system to act as a heat pump.

In Example 6, the embodiments of any preceding paragraph or combination thereof further include wherein the flow control device includes at least one of the separator or the expansion device.

In Example 7, the embodiments of any preceding paragraph or combination thereof further include a compressor discharge temperature sensor in electronic communication with the flow control device.

In Example 8, the embodiments of any preceding paragraph or combination thereof further include an accumulator.

In Example 9, the embodiments of any preceding paragraph or combination thereof further include wherein the accumulator includes the separator, and a first portion of the accumulator contains the refrigerant in a gaseous state and a second portion of the accumulator contains the refrigerant in a liquid state. The system further includes a valve positioned downstream of the accumulator and upstream of the compressor, the valve operable to combine the gaseous refrigerant and the liquid refrigerant from the accumulator into a mixture having a specified quality.

In Example 10, the embodiments of any preceding paragraph or combination thereof further include wherein the separator is further positioned upstream of the evaporator to separate the refrigerant from the expansion device into the liquid refrigerant and the gaseous refrigerant. The liquid refrigerant from the expansion device is vaporized in the evaporator prior to being combined with the gaseous refrigerant from the expansion device.

Example 11 is a method of operating an HVAC system. The method includes condensing high-pressure refrigerant in a condenser of the HVAC system. The method also includes reducing the pressure of the high-pressure refrigerant exiting the condenser to a low-pressure refrigerant in an expansion device of the HVAC system. The method further includes evaporating the low-pressure refrigerant in an evaporator of the HVAC system. The method also includes separating the low-pressure refrigerant into a low-pressure liquid refrigerant and a low-pressure gaseous refrigerant in a separator of the HVAC system. The method further includes combining the low-pressure liquid refrigerant from the separator and the low-pressure gaseous refrigerant from the separator. The method also includes compressing the combined low-pressure refrigerant with a compressor of the HVAC system.

In Example 12, the embodiments of any preceding paragraph or combination thereof further include wherein an accumulator of the HVAC system includes the separator. Separating the low-pressure refrigerant into the low-pressure liquid refrigerant and the low-pressure gaseous refrigerant includes separating the low-pressure refrigerant exiting the evaporator into the low-pressure liquid refrigerant and the low-pressure gaseous refrigerant in the accumulator. The method further includes storing the low-pressure liquid refrigerant and the low-pressure gaseous refrigerant in the accumulator In Example 13, the embodiments of any preceding paragraph or combination thereof further include wherein combining the low-pressure liquid refrigerant from the separator and the low-pressure gaseous refrigerant from the separator includes combining the low-pressure gaseous refrigerant and the low-pressure liquid refrigerant stored within the accumulator into a refrigerant mixture having a specified quality. Compressing the low-pressure refrigerant with the compressor includes compressing the refrigerant mixture with a compressor.

In Example 14, the embodiments of any preceding paragraph or combination thereof further include monitoring a discharge temperature of the compressor, wherein combining the low-pressure liquid refrigerant from the separator and the low-pressure gaseous refrigerant from the separator comprises combining the low-pressure liquid refrigerant from the separator and the low-pressure gaseous refrigerant from the separator based on the discharge temperature of the compressor.

In Example 15, the embodiments of any preceding paragraph or combination thereof further include wherein combining the low-pressure liquid refrigerant from the separator and the low-pressure gaseous refrigerant from the separator includes combining the low-pressure gaseous refrigerant from the separator with the low-pressure refrigerant exiting the evaporator.

In Example 16, the embodiments of any preceding paragraph or combination thereof further include flowing condensate from the evaporator through or over a shell of the compressor to cool the compressor.

In Example 17, the embodiments of any preceding paragraph or combination thereof further include blowing air over the compressor to cool the compressor.

In Example 18, the embodiments of any preceding paragraph or combination thereof further include actuating a flow control device of the HVAC system to alternate between a heating mode of the HVAC system and a cooling mode of the HVAC system.

In Example 19, the embodiments of any preceding paragraph or combination thereof further include wherein the flow control device includes the expansion device.

In Example 20, the embodiments of any preceding paragraph or combination thereof further include wherein the flow control device includes a separator.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A heating, ventilation, and air-conditioning ("HVAC") system for use with a refrigerant, the HVAC system comprising:

a compressor operable to compress the refrigerant;

a condenser positioned downstream of the compressor; the condenser operable to condense the refrigerant;

an evaporator positioned downstream of the condenser, the evaporator operable to vaporize the refrigerant;

a separator positioned downstream of the condenser and downstream of the evaporator, the separator operable to separate the refrigerant into liquid refrigerant and gaseous refrigerant;

a temperature sensor operable to measure a temperature of the refrigerant leaving the compressor; and an adjustable three-way valve controllable based on the temperature of the refrigerant leaving the compressor measured by the temperature sensor to combine the gaseous refrigerant from the separator and the liquid refrigerant from the separator into a mixture having a specified vapor quality to lower a temperature of the refrigerant entering the compressor as well as the temperature of the refrigerant leaving the compressor.

2. The system of claim 1, further comprising tubing configured to flow condensate from an external surface of the evaporator through or over a shell of the compressor.

3. The system of claim 1, further comprising a fan operable to blow air over the compressor.

4. The system of claim 1, further comprising a receiver.

5. The system of claim 1, wherein the HVAC system comprises a heat pump.

6. The system of claim 1, further comprising an accumulator positioned downstream of the evaporator.

7. The system of claim 6, wherein:

the accumulator comprises the separator; and a first portion of the accumulator contains the refrigerant in a gaseous state and a second portion of the accumulator contains the refrigerant in a liquid state.

8. A method of operating an HVAC system, the method comprising:

condensing high-pressure refrigerant in a condenser of the HVAC system;

reducing the pressure of the high-pressure refrigerant exiting the condenser to a low-pressure refrigerant;

evaporating the low-pressure refrigerant in an evaporator of the HVAC system;

separating the low-pressure refrigerant into a low-pressure liquid refrigerant and a low-pressure gaseous refrigerant in a separator of the HVAC system;

combining the low-pressure liquid refrigerant from the separator and the low-pressure gaseous refrigerant from the separator into a refrigerant mixture using an adjustable three-way valve;

compressing the refrigerant mixture with a compressor of the HVAC system;

measuring a temperature of the refrigerant leaving the compressor with a temperature sensor; and controlling the adjustable three-way valve based on the temperature of the refrigerant leaving the compressor measured by the temperature sensor so that the mixture has a specified vapor quality to lower a temperature of the refrigerant entering the compressor as well as the temperature of the refrigerant leaving the compressor.

9. The method of claim 8, wherein:

an accumulator of the HVAC system comprises the separator;

separating the low-pressure refrigerant into the low-pressure liquid refrigerant and the low-pressure gaseous refrigerant comprises separating the low-pressure refrigerant exiting the evaporator into the low-pressure liquid refrigerant and the low-pressure gaseous refrigerant in the accumulator; and the method further comprises storing the low-pressure liquid refrigerant and the low-pressure gaseous refrigerant in the accumulator.

10. The method of claim 8, wherein combining the low-pressure liquid refrigerant from the separator and the low-pressure gaseous refrigerant from the separator comprises combining the low-pressure gaseous refrigerant from the separator with the low-pressure refrigerant exiting the evaporator.

11. The method of claim 8, further comprising flowing condensate from an external surface of the evaporator through or over a shell of the compressor to cool the compressor.

12. The method of claim 8, further comprising blowing air over the compressor to cool the compressor.

13. The method of claim 8, further comprising alternating operating the HVAC system between a heating mode and a cooling mode.

14. A heating, ventilation, and air-conditioning ("HVAC") system for use with a refrigerant, the HVAC system comprising:

a compressor operable to compress the refrigerant;

a condenser positioned downstream of the compressor, the condenser operable to condense the refrigerant;

a temperature sensor operable to measure a temperature of the refrigerant leaving the compressor;

an adjustable three-way valve positioned downstream of the condenser and operable to separate the refrigerant into a first flow and a second flow; and an evaporator positioned downstream of the adjustable three-way valve, the evaporator operable to receive and vaporize the refrigerant from the first flow, wherein the second flow is bypassed from the evaporator, the vaporized refrigerant from the evaporator is combined with the second flow into a mixture, and the adjustable three-way valve is controllable based on the temperature of the refrigerant leaving the compressor measured by the temperature sensor such that the mixture has a specified vapor quality to lower a temperature of the refrigerant entering the compressor as well as the temperature of the refrigerant leaving the compressor.

* * * * *